US005652474A

United States Patent [19]

Wilshaw et al.

[11] Patent Number: 5,652,474

[45] Date of Patent: Jul. 29, 1997

[54] METHOD OF MANUFACTURING COLD CATHODES

[75] Inventors: Peter Richard Wilshaw; Emily Boswell, both of Oxford, United Kingdom

[73] Assignee: British Technology Group Limited, London, United Kingdom

[21] Appl. No.: 381,842

[22] PCT Filed: Aug. 4, 1993

[86] PCT No.: PCT/GB93/01650

§ 371 Date: Feb. 3, 1995

§ 102(e) Date: Feb. 3, 1995

[87] PCT Pub. No.: WO94/03916

PCT Pub. Date: Feb. 17, 1994

[30] Foreign Application Priority Data

Aug. 5, 1992 [GB] United Kingdom ..... 9216647

[51] Int. Cl.[6] ..... H01J 9/02

[52] U.S. Cl. ..... 313/336; 313/309; 313/351; 445/51; 445/46

[58] Field of Search ..... 313/309, 336, 313/351, 495, 496; 445/51, 46

[56] References Cited

U.S. PATENT DOCUMENTS 5,085,746 2/1992 Musselman et al. ..... 204/129.4
5,525,857 6/1996 Gnade et al. ..... 313/336

FOREIGN PATENT DOCUMENTS 0 351 110 1/1990 European Pat. Off. .
0 508 737 A1 10/1992 European Pat. Off. .

OTHER PUBLICATIONS

Kovbasa et al, "Shaping of fine-tip emitters by electrochemical etching", SOV. Phys. Tech. Phys., vol. 20, No. 6, Jun. 1975 Jun. 1975.

*Primary Examiner*—Nimeshkumar Patel
*Attorney, Agent, or Firm*—Wenderoth, Lind & Ponack

[57] ABSTRACT

A cold cathode is formed by providing a body of semiconductor having a surface including at least one projection and subjecting the surface to anodic etching to produce thereon a porous layer.

14 Claims, 5 Drawing Sheets

FIG. 6
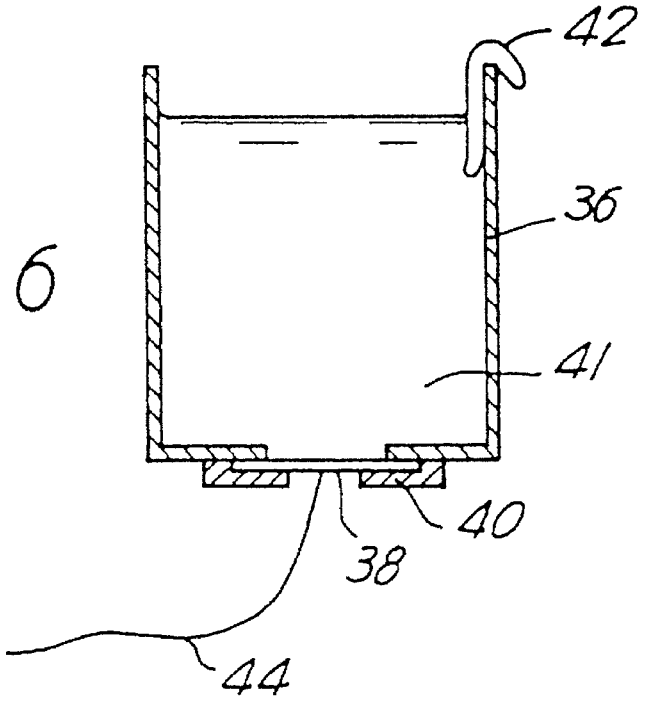
FIG. 7(a)
FIG. 7(b)
FIG. 7(c)
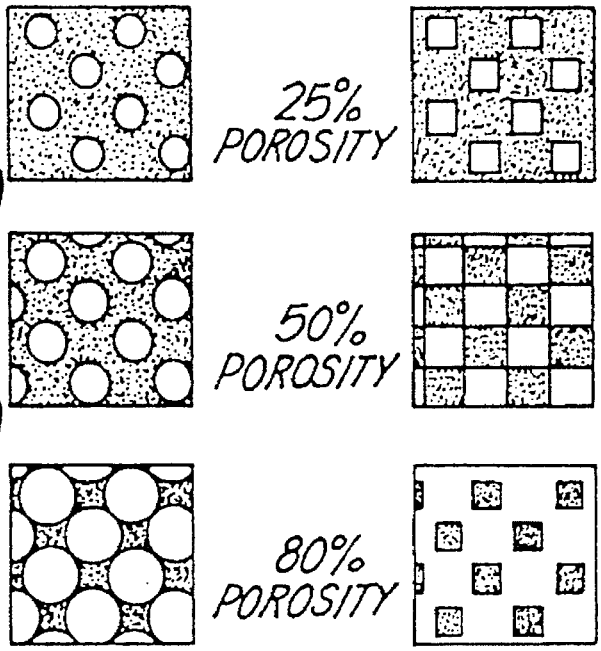
FIG. 7(d)
FIG. 7(e)
FIG. 7(f)

METHOD OF MANUFACTURING COLD CATHODES

BACKGROUND OF THE INVENTION

This invention relates to cold cathodes, which are devices which, without external heating and on application of a relatively small voltage, emit electrons into a vacuum. The invention includes a method of preparation, and also new cold cathodes whose emission characteristics are improved, in some cases by an order of magnitude, over any silicon cathodes described in the literature.

There are two main approaches to forming cold cathodes. One is by the production of negative electron affinity surfaces, and the other by forming material into small pyramids or columns, each with a very sharp point, on the surface of a wafer. This invention is concerned with the latter technique, the provision of sharp tips on a surface.

In order to emit electrons by field emission, the cathode tips must be very sharp, particularly if low operational voltages are required. The electrons are attracted to an anode and a metal gate usually held 0.1 μm to 0.5 μm away is normally used to switch the electron beam on and off. A diagram of a vacuum triode is shown in FIG. 1 and illustrates one possible arrangement of a device. A field emitter is fabricated of metal or semiconductor 10, and includes a cathode tip 12. A metal gate 14 is held around the top of the cathode tip by an insulating layer 16 (of an oxide) and a metal anode 18 is held above the cathode by a further insulating layer 20. When a positive potential difference is applied between the base 10 and the gate 14, an electric field is generated at the tip 12 which allows electrons to tunnel from the cathode material to a vacuum 22. The field at the tip and so the number of electrons emitted are controlled by the gate potential. This basic unit is usually integrated into a very large array, for example as shown in FIG. 2. This comprises a silicon base 24 having a profiled upper surface with silicon pyramids 26. An overlying layer of insulator 28 1 μm thick is itself overlain by a metal grid 30, both gated to reveal the pyramids. The pyramids are shown 10 μm apart, but the packing density of units into the array will depend on the particular application.

The field emission triode shown in the Figures may be used to perform similar functions to a transistor, and there are many applications which have been suggested for vacuum microelectronic devices which may lead to the development of a whole new industry. Possible applications include flat panel displays; superfast computers and memories; a new class of electron sources with large current densities, low extraction voltages, integral focussing and deflection, optical excitation and possibly multiple beams from a single chip; very high frequency amplifiers operating in the GHz range; sub-picosecond electronic devices and high power fast switches; in scientific instrumentation such as electron microscopes and in high radiation environments; for millimeter wave amplification and microwave sources for radar; as pressure sensors; and in electron beam processing of materials and for high gradient accelerators.

The properties which must be successfully developed for the evolution of vacuum microelectronics technology are cold emission, low voltage operation, high current density and small size and compatibility with present-day devices. Low emission noise, long life and uniformity are also required. Developing a fabrication method which gives reproducible cathode geometry and emission, controlling and understanding the physical processes at the emitter surface and practical aspects relevant to real devices, e.g. noise, life time and packing requirements, have all proved to be problems and are taking longer to resolve than expected. This invention focuses on improving the current from and operating voltage of individual cathodes, and also the reproducibility of emission from different individual cathodes; the current density and operating voltage of an array of cathodes should be improved comparably.

Field emitter arrays were first fabricated in 1961. These were of molybdenum and since that time, metals, semiconductors and semiconductors with a metal coating have been investigated for use as the cathode material. Different researchers often use widely differing anode-cathode distances, making it difficult to compare various results in the literature. Currents of 90 μA per tip at an operating voltage of tens of volts have been achieved from solid molybdenum cathodes. The highest current obtained from an n-type silicon is 8 μA at an operating voltage of 750 V. Metal coated silicon tips have produced a maximum emission current of 35 μA, from a tungsten coated tip at an operating voltage of 200 to 330 V.

Metal cathodes can self destruct as they operate at higher currents. Emission uniformity from tip to tip is harder to achieve with metals, due to the stronger field dependence on tip radius and a large metal charge density in the conduction band. Semiconductor arrays can be fabricated using conventional techniques. Silicon is also easier to integrate with present-day devices.

Most geometries which have been examined have been either approximately conical (including pyramidal) or wedges, but rod like geometries have also been investigated. If a conical and wedge emitter have the same base area and the same tip-anode spacings and the same applied voltage, the wedge will generate less current. If the electric field is made the same as that of the conical tip, the field emission current will be considerably larger. Rod-like cathodes have been developed by etching eutectic compositions. These may give greater packing densities but the cathodes are often randomly distributed and would be complicated to integrate with present-day solid state devices.

In many situations the ideal field emitter will produce the highest possible emission current at the lowest possible applied electric field with the smallest possible linear dimensions. FIG. 3 shows various possible field emitter profiles, with a figure of merit f applied to each. A large figure of merit implies a good field emitter, so the best shape shown is the rounded whisker a) and the worst is the wide-angle pyramid d). However, it is also necessary to consider the ultimate limit of field emission current due to electrical breakdown which is determined by the thermal stability of the field emitter, when heat is generated by the electric current. The best shape for this purpose is a wide-angle pyramid and the worst shape a rounded whisker. This is because the temperature gradient of an emitter is largest at the root. Taking account of both factors, an ideal profile for a field emitter is a rounded whisker with a wide base, the Eiffel Tower shape shown in FIG. 4. (C. T. Utsumi, Transactions on Electron Devices, Volume 38, No. 10, October 1991, pages 2276–2283). The radius of curvature of the tip needs to be less than about 50 Å, typically in the range 5 to 25 Å, the smaller the better.

Porous silicon is a product that has been known since the late 1950s, but has been investigated intensively over the last 15 years on account of its interesting electrical properties including the ability to photoluminesce at room temperature. Porous silicon is formed by anodising silicon in a solvent having some dissolving power for the silicon, typically one based on hydrofluoric acid. The pores typically have diameters of 1 to 100 nm, usually a few tens of nm. The thickness of the resulting sponge structure depends on the anodising time. Control over silicon dopant type, resistivity, current density and HF concentration can be used to control density and other properties of the porous silicon (M. I. J. Beale et al., Applied Physics Letters, Volume 46(1), January 1985, pages 86–88). Following the formation of pores by electrochemical dissolution, chemical dissolution can be used to reduce the density by enlarging the pores until the intervening pillars are separate and form a foam or whiskered structure (L. T. Canham, Applied Physics Letters, Volume 57(10), September 1990, pages 1046–1048).

SUMMARY OF THE INVENTION

Anodic etching has been performed on flat silicon wafers. The present invention arose from the idea that a surface layer of porous silicon on the tips of cold cathodes might enhance their field emission properties. This idea has been borne out dramatically in practice. As demonstrated in the experimental section below, one such cold cathode tip gave rise to a current more than 15 times higher than any previously reported for silicon emitters in the literature.

In one aspect the invention provides a method of making a cold cathode, by providing a body of a semiconductor having a surface including at least one projection, which method comprises subjecting the surface to anodic etching.

In another aspect the invention provides a cold cathode comprising a body of a semiconductor having a surface including at least one projection and having a porous surface layer of semiconductor or metal.

The body is of a semiconductor, i.e. not of a metal which could not be subjected to the anodisation treatment. The body is preferably of doped silicon e.g. n-type or p-type silicon and can be either single crystal or polycrystalline material. Most work on cold cathodes has been performed on n-type silicon, although there is no reason in principle why p-type silicon should not work equally well. It is expected that in future techniques for developing good quality porous silicon from amorphous silicon will also be developed. Our initial work, reported herein, was performed with wafers of p-type silicon. Other semiconductors, e.g. III–V type semiconductors are possible alternatives to silicon; it is known that suitably formed tips of such materials are capable of acting as cold cathodes; anodising processes are expected to be similarly capable of forming porous or filamentous surface layers.

The starting semiconductor body needs to have at least one projection, most usually an array of projections, and these are preferably sufficiently pointed and sufficiently sharp to give the body cold cathode properties even before it is subject to anodic etching. We were not able, merely by anodic etching of a flat silicon wafer, to generate a product having cold cathode properties. But we have been successful in taking a silicon wafer, having projections not sharp enough by themselves for field emission, and anodically etching it to give a product having cold cathode properties. Where the starting body has cold cathode properties itself, the anodic etching treatment substantially improves them.

The parameters of the anodic etching operation can be chosen from the published literature taken with common general knowledge in the field. The electrolyte needs to have a limited dissolving power for the semiconductor body. The diameter and spacing of the pores introduced by anodic etching may be controlled by controlling the applied current density. Improved properties may be achieve by use of AC or a biased waveform rather than straight DC. Anodizing results in a spongy surface layer whose thickness may be determined by the amount of electricity passed, i.e. by a combination of current density and anodic etching time, and here we have found that dramatic improvements can be achieved by the use of rather small amounts of electricity. For example, where the literature teaches anodic etching for 5 minutes, we used 30 seconds under the same conditions with success.

Anodic etching of silicon is described for example in the following papers:

R. L. Smith and S. D. Collins in J. Appl. Phys., 71 (8); R, a review published on 15 Apr. 1992.

M. I. J. Beale et al in Appl. Phys. Letters, 46, No.1, published in January 1985.

P. C. Searson, J. M. Macaulay and S. M. Prokes in J. Electrochem. Soc. 139, No. 11 (1992).

The density of the porous layer can be controlled by an appropriate choice of the electrolyte/etchant, so as to achieve partial electrochemical dissolution and partial chemical dissolution. If desired, the anodic etching may be performed by a partial electrochemical dissolution step, followed by a partial chemical dissolution step in the same or a different solvent.

We currently believe that the anodic etching step results in a layer of porous silicon on the surface of our wafers, which may have the form of a foam or a series of separate or partly joined threads or whiskers. However, we have no direct evidence that such a structure is actually formed. It is possible, though currently believed unlikely, that our anodic etching step simply sharpens the pre-existing projections on the semiconductor surface, without creating a porous structure at all. For practical purposes, anodic etching improves cold cathode performance and it is this, rather than the underlying structure of the product, that is important.

It is possible to convert the porous silicon (or other semiconductor) to porous metal. For example, use can be made of tungsten hexafluoride which boils at 17° C. If porous silicon is heated in tungsten fluoride vapour, a chemical reaction proceeds which involves replacing the solid silicon in the fibrils with solid tungsten. The displaced silicon is liberated as silicon tetrafluoride which is a gas and easily removed. Since the silicon fibrils are so fine (often around 3 nm) they can be completely converted to tungsten in this way in a reasonably short time.

Porous tungsten is expected to be a superior field emitter, since it has a higher electrical conductivity than silicon, and the very tips of the fibrils will withstand much higher temperatures before they are vaporised. Vaporisation of emitters is thought to be one cause of failure for cold cathodes. By means of the principle here described, other metals than tungsten can be used to replace silicon or other semiconductor fibrils so as to make better cold cathodes.

BRIEF DESCRIPTION OF THE DRAWINGS

FIG. 6 shows equipment used in anodic etching of cathode arrays.

FIG. 7 shows various etched pore samples.

DETAILED DESCRIPTION OF THE INVENTION

EXPERIMENTAL

Figure 1:
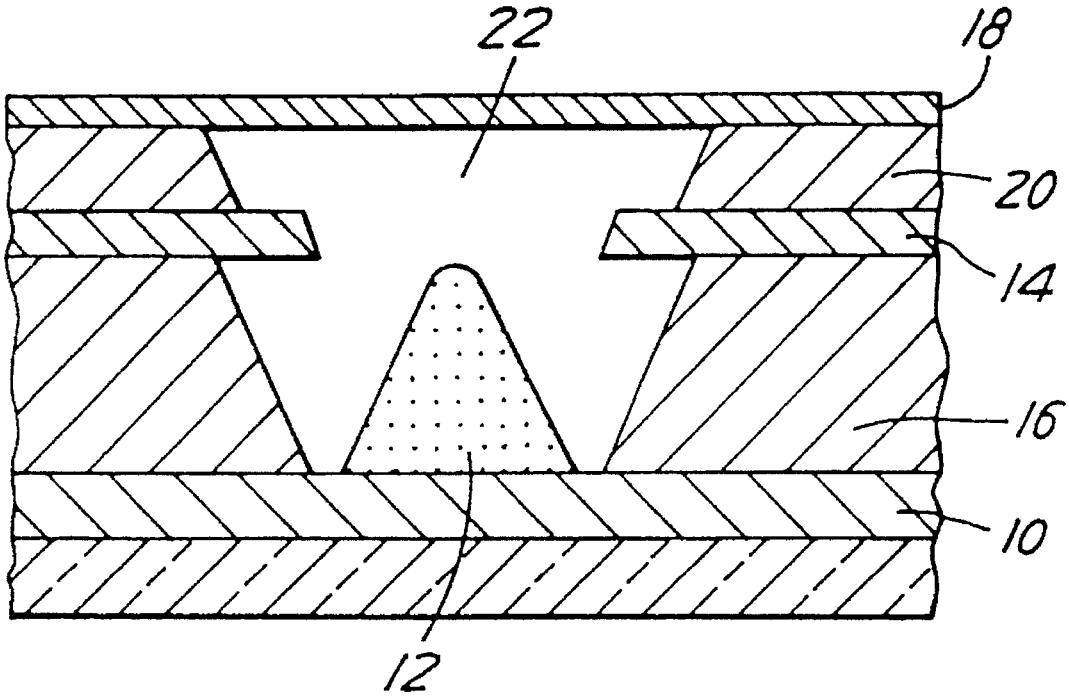
FIG. 1 shows a basic vacuum triode unit.
Figure 2:
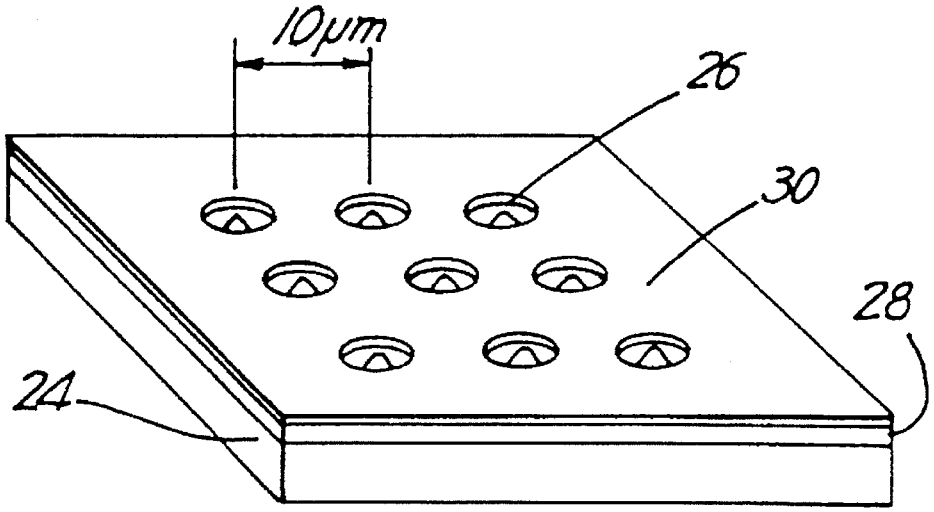
FIG. 2 shows an array of basic units in accordance with FIG. 1.
Figure 3:
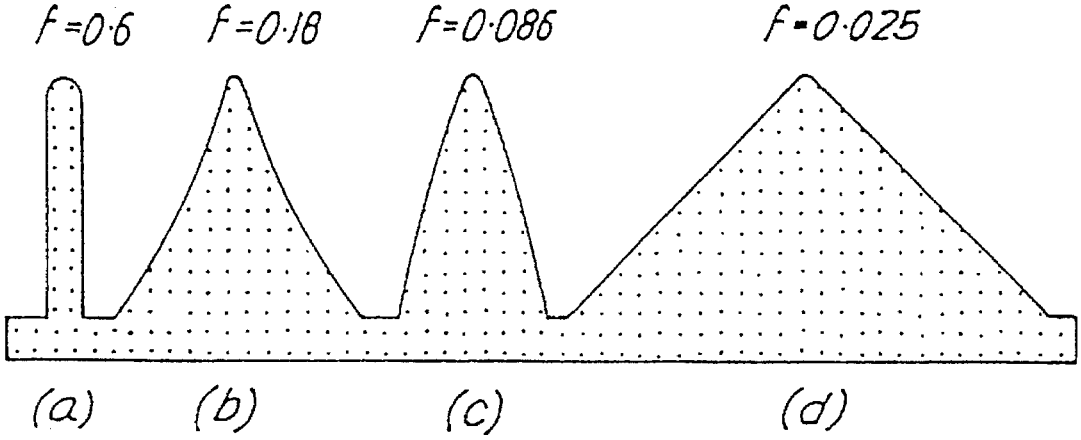
FIG. 3 shows various possible field emitter profiles.
Figure 4:
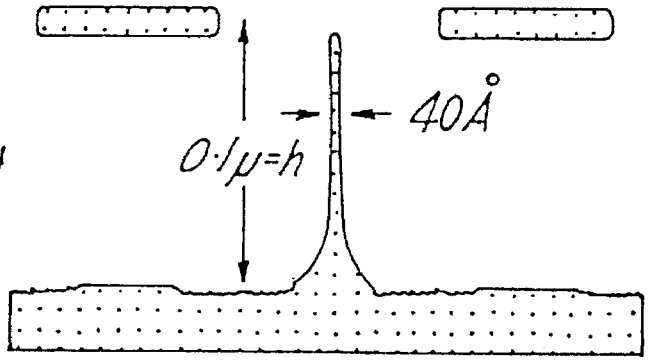
FIG. 4 shows a field emitter profile shaped as a rounded whisker with a wide base.
Figure 5A:
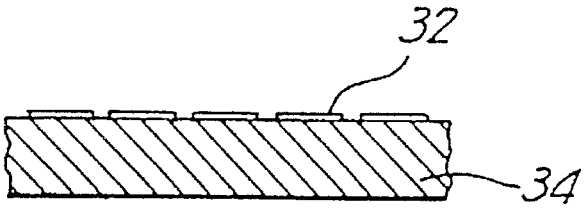
FIG. 5 shows intermediate and final silicon substrates as formed by etching.
Figure 5B:
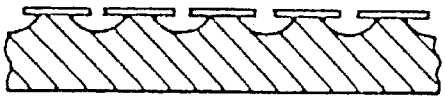
Figure 5C:
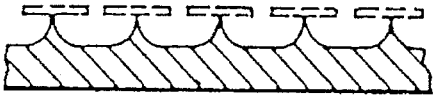

Silicon wafers were heated in wet oxygen at 950° C. for 5 hours to form a uniform oxide layer 0.17 μm thick on the surface. A positive resist polymer film was applied to the oxidised surface with a mask overlaid, the coated oxidised surface was subjected to UV radiation. Thereafter the photoresist was removed from the illuminated areas. A solvent comprising 389 g of $NH_4F$, 140 ml of HF per liter was used to selectively dissolve the exposed $SiO_2$ regions. This gave rise to an intermediate product shown as 1 in FIG. 5, containing spaced regions 32 of $SiO_2$ overlying an Si substrate 34.

There are various etch methods which have been used to produce cathode arrays including dry etching (ion milling, plasma etching) methods and wet etching. We used a standard isotropic wet etch system comprising 70% nitric, 10% acetic and 48% hydrofluoric acids in a 25:10:1 volume ratio. This solvent etches the silicon leaving the silicon dioxide regions relatively intact, to give first the intermediate product 2 in FIG. 5 and finally the final product 3, when the silicon dioxide patches fall off leaving silicon projections exposed. The mask used by us had nominally square rather than round holes, with the result that our projections had wedge-shaped rather than conical tips.

It has been reported in the literature that silicon cathodes may be sharpened further after wet etching by oxidation producing atomically sharp apexes. This method probably exploits the inhibition of oxidation at regions of high curvature which occurs because the stress caused at a Si—$SiO_2$ interface on a non-polar surface due to the increase in molar volume from oxidation. The stress at a silicon step is thought to reduce the oxidation rate by increase in the energy barrier for oxidation. Wet or dry oxidation may be used. Sharpening both decreases the radius of curvature and increases the aspect ratio of the cathode and increases uniformity of geometry. Some of our cathode arrays were placed in the wet oxidation furnace at 950° C. for 5 hours, and were then dipped in buffered HF to remove the oxide layer until hydrophobic.

Some of our cathode arrays, including some that had and some that had not been subjected to oxidation sharpening, were then subjected to anodic etching. A surface layer of porous silicon was produced from bulk silicon by partial electrochemical dissolution in hydrofluoric acid based electrolytes, generally as described in the papers by M. I. J. Beale et al. and L. T. Canham referred to above. The equipment used is shown in FIG. 6. A PTFE container 36 has a hole cut in the bottom and a silicon wafer 38 positioned by means of a clamp 40 covering the hole. The container was filled with electrolyte 41. A platinum electrode 42 was positioned as a cathode in the electrolyte, and the silicon wafer was connected up at 44 as the anode. The etchant/electrolyte was a 1:1 mixture of HF and ethanol. This was poured into the container and left with a current of 20 mA flowing for various times. A sample of porous silicon on a flat substrate was produced with a time of 5 minutes. A sample of porous silicon on a cathode array was formed with a time of 30 seconds. The electrolyte etch time affected the thickness of the porous silicon. It was estimated that if electrolytically etched for 5 minutes, a 1 μm thick layer of porous silicon was formed. Therefore, making the large assumption that etch depth obeys a linear relationship with time, a sample etched for only 30 seconds had a layer which was 100 nm high at most.

Samples were then left in a solution of neat HF for 90 minutes to enlarge the etched pores as shown in FIG. 7. Here, an intermediate product a) (circular pores) or d) (square pores) of 25% porosity is converted by chemical dissolution to a final product c) or f) of 80% porosity and having separate pillars or fibrils.

Figure 8:
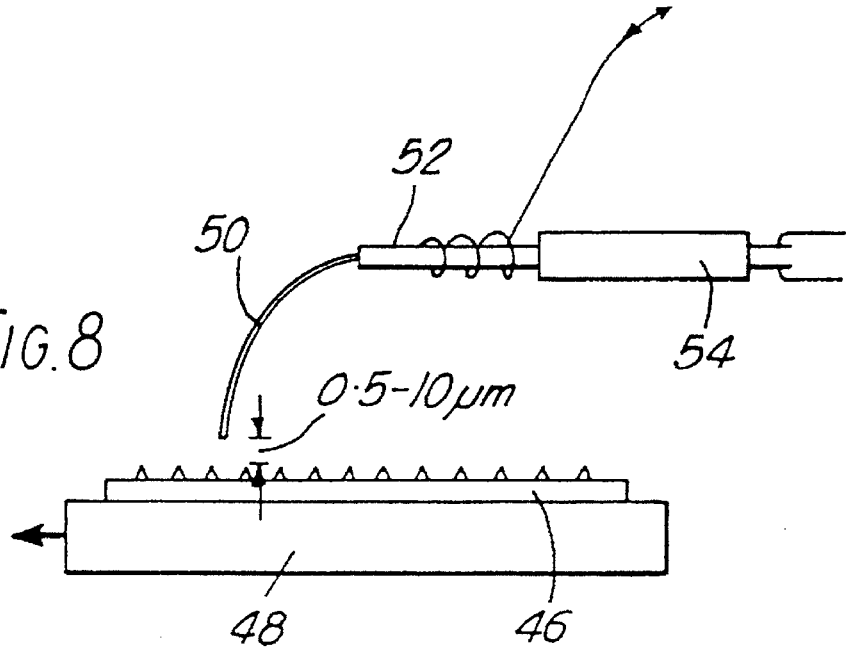
FIG. 8 shows an experimental set up for measuring emissions from cold cathodes.

The ability to measure emissions from individual tips in an array is important, because it is then possible to examine the reproducibility of emission from tip to tip which is vital if field emitter arrays are to be useful. A Philips 505 scanning electron microscope was adapted for field emission-electrical characterisation experiments. This microscope included a micro manipulator for moving a mechanical probe to a high degree of precision above an individual cathode, and the electronics for measuring very small currents to an accuracy of $10^{-13}$ A. The experimental set up is shown in FIG. 8. A silicon cold cathode 46 is mounted on a stage 48 whose position can be accurately controlled in the three orthogonal directions. A tungsten probe 50 is electrochemically polished to have a sharp tip and is mounted at the end of a steel holder 52 provided with appropriate insulation 54.

When the probe was placed in the microscope it was moved by a mechanical micromanipulator to position the probe over the desired area. Once the SEM door was shut its position could be determined from the SEM image. The probe could be positioned with an accuracy of 1.5 μm in the z-direction and 0.2 μm in the x and y-directions by moving the specimen relative to the probe using the precision micromanipulator stage.

A Hivolt step-up transformer was used to provide a power supply which could produce voltages in the range 0 to 2500 V. A computer program allowed a voltage range to be chosen by the operator. The computer would ramp up the voltage over the chosen range with chosen steps. If electrons were emitted, they would be collected by the probe tungsten tip and amplified. The sensitivity of the ammeter could be changed, depending on the magnitude of the collected current. A protector, typically a resistor in the range 1 to 10 mega ohm, was included in the circuit to prevent large voltages being applied across either the computer or the ammeter, which could cause damage in the event of short circuiting. The computer stored the applied voltage and emission current and generated a Fowler-Nordheim plot from this data on a screen.

Several problems encountered during testing were common to all samples:

Accuracy of probe positioning. In general, xy positioning of the probe was not a problem. However, although the z movement was quite sensitive, the measurement of the position of the probe above the tips was very difficult. The positioning of the probe was found to be accurate to 1.5 μm in the vertical direction. From the experimental results, it was observed that moving the probe a distance of 1 μm vertically had a significant effect on the emission current and so the positioning of the probe to an accuracy of only 1.5 μm was a major cause of uncertainty in field emission tests. This led to problems of reproducibility when testing different cathodes across an array, because the probe-apex difference may not have been identical for all cathodes tested.

Oscillation of the probe, perhaps as a result of electrostatic attraction to the stage. The insertion of a series resistor, as mentioned above, may have the beneficial effect of damping down the probe oscillations so improving emission characteristics.

Destruction of the probe. It was difficult to avoid occasional short circuits between the probe and the cold cathode. Damage was reduced by placing a resistor in series with the probe.

RESULTS AND DISCUSSION OF FIELD EMISSION TESTS

There follow two sections, the first describing general field emission trends which were found to be true for most specimens and the second describing the field emission results specific to particular samples.

A) General Trends

Figure 9:
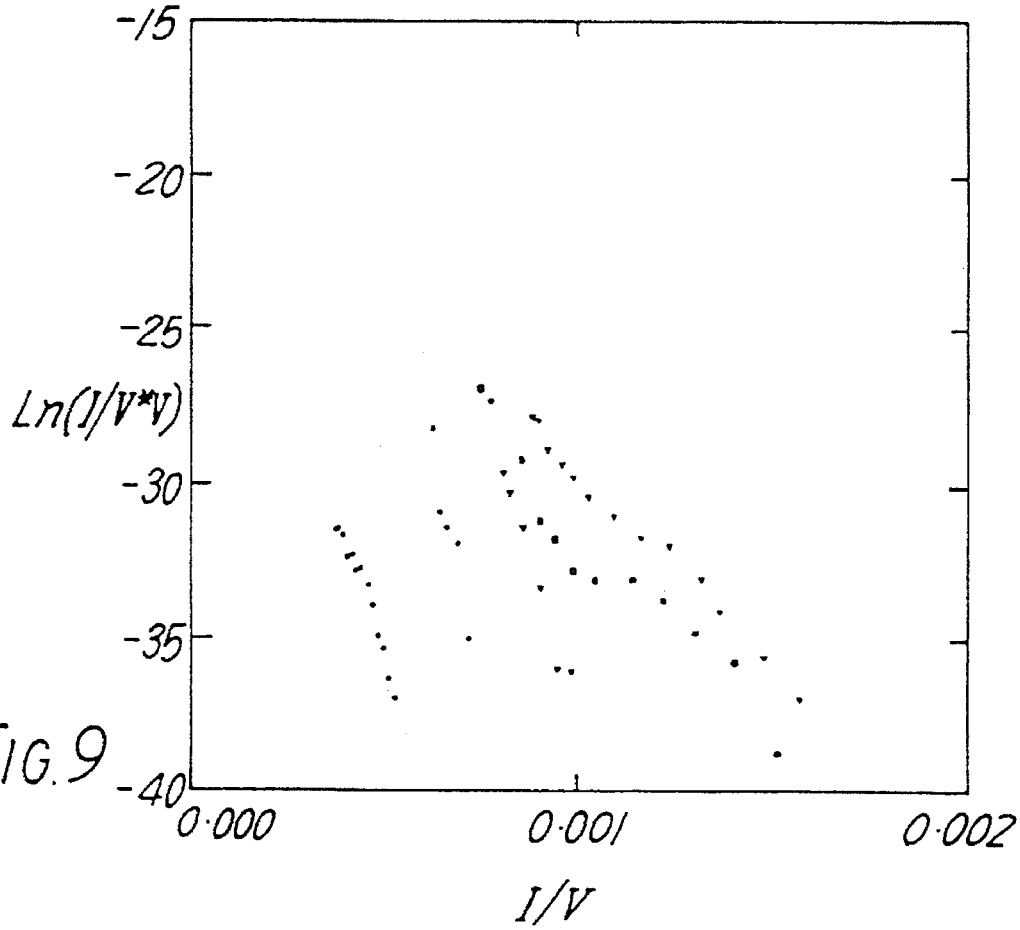
FIGS. 9 and 10 are graphs used to illustrate some of the general trends described.
Figure 10:
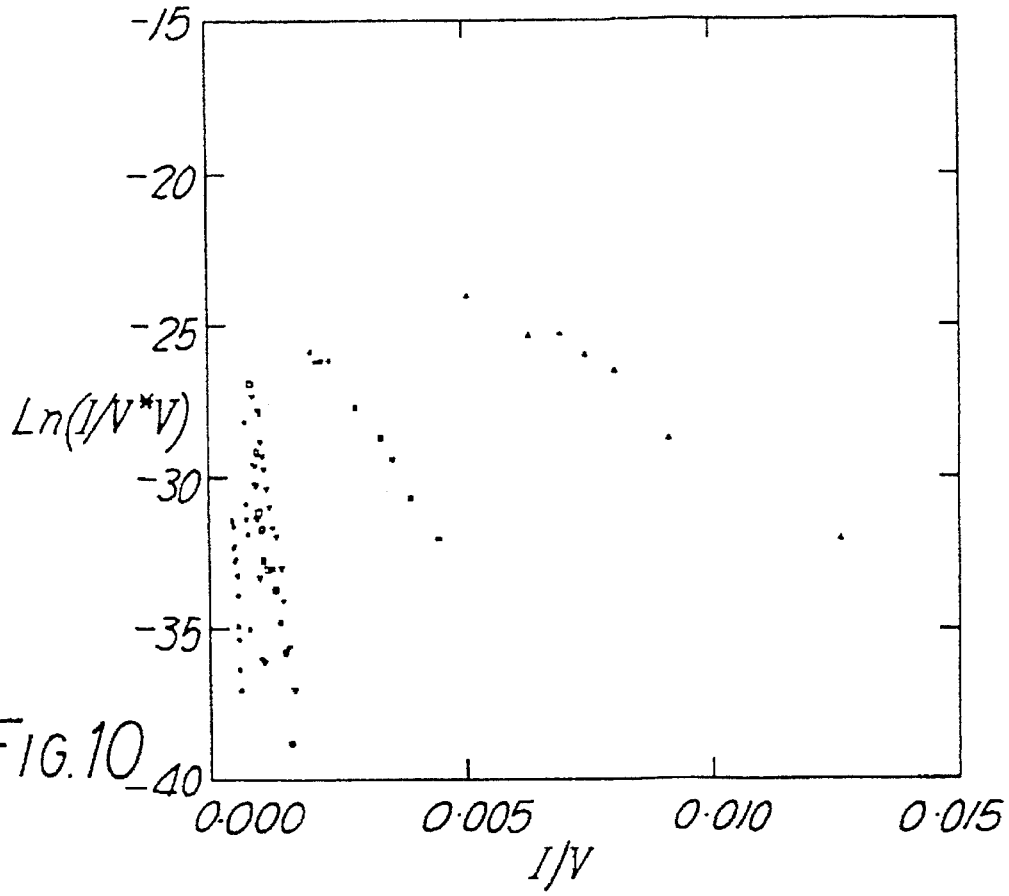
Figure 11:
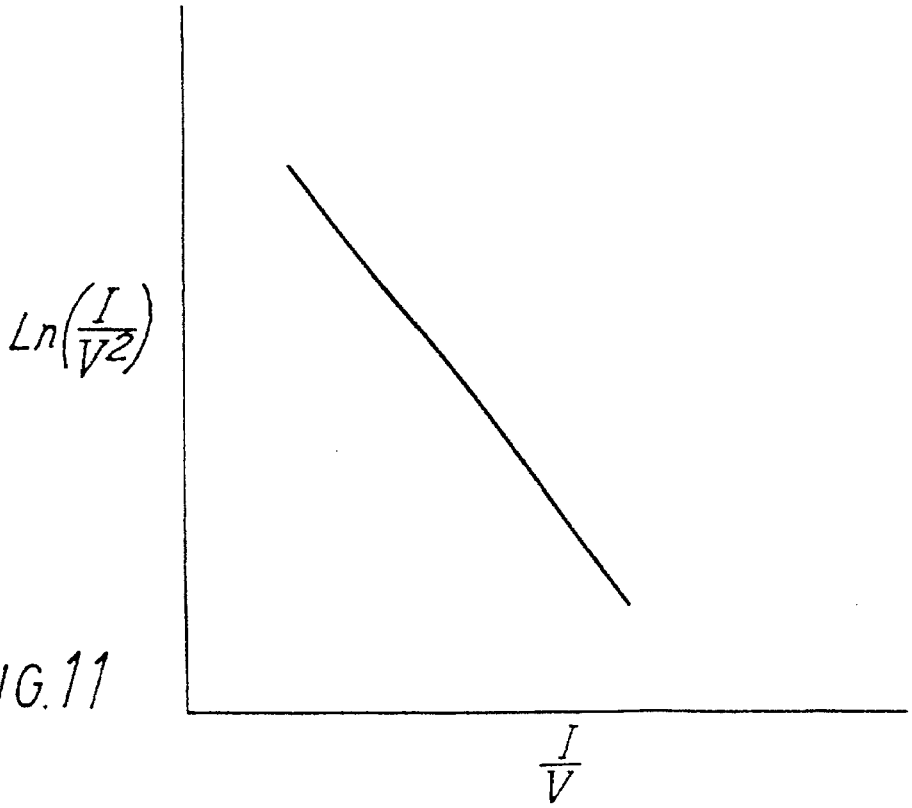
FIG. 11 shows a Fowler-Nordheim plot.

FIGS. 9 and 10 are graphs used to illustrate some of the general trends described. The graphs shown are examples of Fowler-Nordheim plots and are graphs of 1/V against Ln(I/$V^2$). The derivation of this plot from the Fowler-Nordheim equation is described in the literature. The Fowler-Nordheim plot is illustrated in FIG. 11.

FIG. 9 shows several emission curves collected from the same cathode until it blew, with readings taken every 3 minutes. It can be seen that as the time from the onset of testing increased, the emission curve moved steadily towards the right along the horizontal axis and the gradient of the plots appeared to decrease slightly. It also appears that the kink seen in each curve increased with time. This result is obviously significant, as the starting voltage has decreased from 2000 V to 666 V in 12 minutes without any change in the probe-apex difference. The translation of the emission plot along the x-axis indicates a decrease in starting voltage with increasing time.

In FIG. 10, the results from FIG. 9 are included along with two other emission curves taken from the same cathode but with the anode-cathode (probe-apex) distance approximately halved in each case. There is quite a dramatic effect—the starting voltage has been decreased from 666 V to 222 V by changing the anode-cathode distance from 2 μm to 1 μm. When this distance was reduced from 1 μm to 0.5 μm, the starting voltage changed from 222 V to 80 V. (All distances are approximate.) This dependence illustrates one of the major problems in collecting emission data. The starting voltage varies dramatically with anode-cathode distance, and if the probe can be positioned with an accuracy of only 1.5 μm, this makes a great difference to the results. This dependence can cause apparent non-uniformity of emission between tips and makes comparison with results from the literature difficult.

B) Results and Discussion from Particular Specimens

The field emission results are summarised in Table 1. The lowest operating voltage is noted for each specimen. As the current-voltage characteristics of Fowler-Nordheim emission obey an exponential relationship, the lowest operating voltage is that voltage at which the current starts to become appreciable. The highest emission current obtained from the cathode is also important and is the highest current obtainable before the cathode blew. Such an event may have been caused by electrostatic attraction between probe and cathode causing a short-circuit, or by thermal breakdown of the emitting cathode, or by a combination of the two effects. A specimen was deemed not to have emitted if the current did not begin to show a marked increase before cathode destruction. All cathodes were tested with a probe-apex distance of about 2 μm unless otherwise stated.

TABLE 1

Table Summarising Field Emission Results

| SAMPLE TYPE | EMISSION CURRENT | STARTING VOLTAGE | COMMENTS |
|---|---|---|---|
| 1) Un-Oxidation-Sharpened p-type silicon cathodes | Max I = 1.2 uA at 740 V<br>Average I = 0.22 uA<br>Standard Deviation = 0.4 uA | Lowest Starting Voltage = 555 V with 0.0003 uA<br>Average voltage = 1388 V<br>SD = 763 V | 25% of tips tested emitted<br>28 tips tested |
| 2) Oxidation sharpened p-type silicon cathodes | Maximum current = 5.5 uA at 1840 V.<br>Average current = 1.5 uA<br>SD = 2 uA | Lowest Starting Voltage = 80 V with $10^{-13}$A.<br>Average = 980 volts<br>SD = 468 volts | 100% of tips tested emitted<br>14 tips tested |
| 3) Flat-topped silicon p-type cathodes with porous silicon on top | Max I = 1.7 uA at 475 V.<br>Average = 0.024 uA<br>SD = 0.064 uA | Lowest Starting Voltage = 400 V with 0.0001 uA.<br>Average = 724 V<br>SD = 288 V | 100% of tips tested emitted<br>18 tips tested |
| 4) Sharp silicon cathodes with porous silicon on top<br>Measured with a 1 mega ohm resistor | Highest Current = 90 uA<br>Average current = 25 uA | Lowest Starting Voltage = 555 V with 0.0064 uA. | 100% of tips tested emitted<br>30 tips tested |

TABLE 1-continued

Table Summarising Field Emission Results

| SAMPLE TYPE | EMISSION CURRENT | STARTING VOLTAGE | COMMENTS |
|---|---|---|---|
| 5) As in 7) but measured with a 10 mega ohm resistor | Highest current = 151 uA at 2000 V. Average current = 61 uA SD = 50 uA Because there is a voltage across the resistor, it is expected that the actual voltage applied to the tip is 500 V not 2000 V. | Lowest voltage = 110 V with 1.6 uA. Average voltage - there are two sets - one with average of 320 V. Other has an average of 1260 V. | Two sets of data were taken under these conditions but at different times. The first set had very low starting voltages - the later set had high starting voltages. The current didn't change much. 11 tips were tested and all emitted. |

1. Non-Oxidation Sharpened p-Type Silicon Cathodes 28 tips were tested, and of these 25% were capable of field emission. For one cathode, emission was achieved with a current as high as 1.2 μA, at an operating voltage of 740 V, but the maximum current before destruction was generally much lower at about 0.22 μA. The lowest starting voltage for these samples was 555 V with an average of 1380 V.

2. Oxidation Sharpened p-Type Silicon Cathodes 14 tips were tested and 100% shown to be capable of field emission. The maximum and average emission currents obtained from this sample were higher than the unsharpened sample by a factor of 5, reaching 5.5 μA. The lowest starting voltage was found to be 80 V, much lower than for the unsharpened tips, and the average starting voltage was also lower by 400 V.

The maximum emission reported in the literature is 8 μA, comparable to our figure of 5.5 μA. However, our operating voltage was more than twice that found for the same current in the literature. One factor which may contribute to this is that the shape of our cathodes at the apex are ridges rather than points, and also the apex angle of our pyramids is rather large (≈126°) which thus leads to a relatively small field enhancement factor and hence relatively large operating voltages.

3. Porous Silicon Coated D-Type Silicon Cathodes

In initial experiments, a layer about 1 μm thick of porous silicon was formed on a flat p-type silicon substrate. Field emission was not expected and was not detected.

Non-oxidised p-type silicon cathodes which had been given a porous silicon coating by the method described above, were tested next. 18 tips were tested. Emission occurred at starting voltages as low as 400 V. The maximum emission current achieved was 1.7 μA although most were in the order of $10^{-9}$ A. 100% of tips tested emitted. This specimen does not perform as well as sharp silicon tips without porous silicon present, however, this is a sample of blunt tips and it can be seen that when porous silicon was not present on the flat-topped tips, emission generally did not occur at all. This is a very important result as it shows that the novel porous silicon coating markedly improves emission and can be used to cause emission to occur on a tip where it would not normally emit.

4. Shape of Emission Plots

There actually appear to be three different sorts of field emission plots which are obtained from this specimen. The first type seem to have starting voltages of 400 V which is quite low but the emission current does not go much higher than $10^{-9}$ A. The plot consists of several peaks—as if multiple emission from more than one fibril has occurred. The second type have starting voltages of 800 V or higher but the emission current is higher—up to $10^{-7}$ A. This type of curve does not have several peaks but is a straight line like a Fowler-Nordheim plot. The third type of plot appears to be a mixture of the first two types of plot. It is a straight line with a much smaller gradient than usual, but it has several bumps in it. The starting voltage for this type of emission is as low as for the first type if not lower. The emission current appears to be much higher than the other two types.

Fowler-Nordheim plots for porous silicon are steep. A few plots show multiple emission, as though one fibril was emitting and exploding, followed by another. The plot containing record emission current of 1.7 μA from a blunt tip has a lower gradient, indicating a higher enhancement factor than the other tips.

5. Sharp Silicon Arrays with Porous Silicon

The important result of the last section which showed that an emission current of 1.7 μA could be obtained from blunt cathodes only if covered with a thin layer of porous silicon. It was thought possible that if porous silicon could be formed on top of very sharp cathodes, the field enhancement factor would be even higher and even lower starting voltages and higher emission currents could result than for the blunt cathodes. The next sample to be examined was therefore a specimen containing sharp cathodes with a thin layer of porous silicon on top estimated to be <0.1 μm thick.

This specimen was measured with a 1 mega ohm resistor in place to limit the damage to the probe. The highest current produced was 90 μA, higher than any of our other silicon tips. The highest recorded result from the literature was 8 μA and so the results from porous silicon on sharp silicon cathodes appear to have produced the highest field emission current ever from a silicon field emitter. The specimen was then examined with a 10 mega ohm resistor. The highest emission current then obtained was 151 μA, with an average value of 60 μA. This is an extremely high value, more than 15 times higher than the largest emission current reported in the literature. The average emission current from molybdenum is 100 μA, although a few have been found to emit 500 μA. The highest current obtained from sharp porous silicon cathodes is therefore higher than the average emission current from molybdenum. The operating voltage has also been reduced to 111 V which is an average value for silicon emission as quoted in the literature. However, our result is obtained with a relatively large cathode anode spacing of approximately 2 μm and it is expected that the voltage will be correspondingly reduced when small spacings are used. Under such circumstances very low voltage emission <50 volts and possibly <20 V would be achieved from a similar cathode.

The Fowler-Nordheim plots are, in general, less noisy than plots from silicon cathodes without a porous layer. This could show that emission from porous silicon is usually more stable than a normal silicon cathode. This is a statistical effect. A few plots show multiple emission as before. Most exhibit a kink in the field emission curve, which is assumed to be due to the three stage emission process. The effect of gaining higher emission current and lower operating voltage by adding a resistor is not understood and has not been reported elsewhere. It is possible that one reason that larger currents are achieved than elsewhere is that the addition of the series resistor delays the onset of catastrophic breakdown at the cathode tip. This can be explained by considering that when a series resistor is placed close to the anode it partly decouples the anode from the rest of the high voltage circuitry. In this way the electrostatic energy E, stored close to the cathode is also much reduced according to $E<\frac{1}{2}CV^2$ where V is the applied voltage and C is the capacitance only of the circuitry between the anode tip and series resistor and does not include the capacitance of the remaining circuitry. This reduction in stored energy at any given applied voltage means that there is less energy readily available to generate a plasma thus delaying catastrophic breakdown until higher applied voltages.

6. Emission Uniformity

When plain silicon pyramids were measured which had not been oxidation-sharpened only about 25% would emit current. For pyramids where the wet etching process had not been properly completed, many cathodes would not field emit even after oxidation sharpening. However, in all cases when such wafers were covered with porous silicon, emission was obtained from every pyramid tested. Thus the porous silicon has the effect of enabling field emission from cathodes which would otherwise be too blunt. The scatter in peak current values obtained from porous treated cathodes was less than that produced from plain silicon. For porous treated cathodes, most peak emission currents fell within a factor of two of the average. It is believed that the improved reproducibility between these cathodes is due to the ease with which a uniform layer of porous silicon can be produced. When the porous silicon is absent the cathode performance is entirely dependent on the morphology of its etched and oxidised surface which is difficult to control to the accuracy required to give reproducible emission between tips.

The results are very impressive and have been obtained from an entirely novel field emitting material. Porous silicon has achieved the aim of producing high currents and low voltage operation.

We claim:

1. A method of making a cold cathode, by providing a body of a semiconductor having a surface including at least one projection, which method comprises subjecting the surface to anodic etching.

2. A method as claimed in claim 1, wherein the body of semiconductor having a surface including at least one projection itself had cold cathode properties even before being subjected to anodic etching.

3. A method as claimed in claim 1, wherein the semiconductor is of silicon.

4. A method as claimed in claim 1, wherein the anodic etching is performed under conditions to form a porous surface layer on the semiconductor body.

5. A method as claimed in claim 1, wherein the anodic etching is performed by a partial electrochemical dissolution step, followed by a partial chemical dissolution step.

6. A method as claimed in claim 5 wherein both partial dissolution steps are performed in hydrofluoric acid based solutions.

7. A cold cathode comprising a body of a semiconductor having a surface including at least one projection and having a porous surface layer of semiconductor or metal.

8. A cold cathode as claimed in claim 7, wherein the body of semiconductor having a surface including at least one projection itself had cold cathode properties even before formation of the porous surface layer.

9. A cold cathode as claimed in claim 7, wherein the semiconductor body is of silicon and has a surface layer of porous silicon.

10. A cold cathode as claimed in claim 7, wherein the surface of the semiconductor body includes an array of projections.

11. A cold cathode comprising a body of a semiconductor having a surface including at least one projection and having a surface layer of semiconductor or metal which has been subjected to anodic etching.

12. A cold cathode as claimed in claim 11, wherein the body of semiconductor having a surface including at least one projection itself had cold cathode properties even before it was subjected to anodic etching.

13. A cold cathode as claimed in claim 11, wherein the semiconductor body is of silicon.

14. A cold cathode as claimed in claim 11, wherein the surface of the semiconductor body includes an array of projections.

* * * * *